US009924788B2

(12) United States Patent
Schuster

(10) Patent No.: US 9,924,788 B2
(45) Date of Patent: Mar. 27, 2018

(54) HAIR BRUSH WITH MOVABLY MOUNTED BRISTLES

(71) Applicant: GEKA GmbH, Bechhofen (DE)

(72) Inventor: Erwin Schuster, Bechhofen (DE)

(73) Assignee: GEKA GmbH, Bechhofen (DE)

( * ) Notice: Subject to any disclaimer, the term of this patent is extended or adjusted under 35 U.S.C. 154(b) by 857 days.

(21) Appl. No.: 14/308,022

(22) Filed: Jun. 18, 2014

(65) Prior Publication Data

US 2014/0373294 A1 Dec. 25, 2014

(51) Int. Cl.

| | |
|---|---|
| ***A46B 3/00*** | (2006.01) |
| ***A46B 7/06*** | (2006.01) |
| ***A46B 9/02*** | (2006.01) |
| ***A46B 7/02*** | (2006.01) |
| ***A46B 7/04*** | (2006.01) |

(52) U.S. Cl.

CPC ..... *A46B 9/023* (2013.01); *A46B 3/005* (2013.01); *A46B 7/023* (2013.01); *A46B 7/04* (2013.01); *A46B 7/06* (2013.01); *A46B 2200/104* (2013.01)

(58) Field of Classification Search

CPC .. A46B 1/00; A46B 3/005; A46B 3/20; A46B 3/22; A46B 7/06; A46B 9/023; A46B 2200/104

USPC ..... 15/201

See application file for complete search history.

(56) References Cited

U.S. PATENT DOCUMENTS

| | | | | |
|---|---|---|---|---|
| 4,057,867 A | | 11/1977 | Ballin | |
| 4,423,531 A | * | 1/1984 | Wall | A46B 3/005 132/126 |
| 4,500,939 A | | 2/1985 | Gueret | |
| 5,755,242 A | * | 5/1998 | Denebeim | A45D 1/04 132/232 |
| 5,765,575 A | * | 6/1998 | Denebeim | A45D 1/04 132/227 |
| 6,006,395 A | | 12/1999 | Tiramani et al. | |

FOREIGN PATENT DOCUMENTS

| | | |
|---|---|---|
| DE | 19949671 A1 | 4/2001 |
| GB | 2118029 A | 10/1983 |
| WO | 2007092016 A1 | 8/2007 |

* cited by examiner

*Primary Examiner* — Randall Chin

(57) ABSTRACT

Hair brush with an array of bristles which are fastened on a flexible pad of bristles which yields during combing so that the position and/or location of the bristles is changed as a result, the bristles being composed of plastic, wherein the pad of bristle and the bristles are composed of a single piece and wherein the pad of bristles has the configuration of a flexible membrane.

12 Claims, 6 Drawing Sheets

HAIR BRUSH WITH MOVABLY MOUNTED BRISTLES

FIELD OF THE INVENTION

The invention relates to a hair brush.

BACKGROUND OF THE INVENTION

Hair brushes which adapt to a greater or lesser extent to the shape of the head are known. Such hair brushes are equipped with soft bristles which are adapted to the shape of the head due to the fact they bend to a greater or lesser extent. However, the softer the bristles, the worse in general their combing action. Moreover, in the case of brushes, whose adaptability is solely ensured by their soft bristles, the array of bristles cannot be adjusted adequately enough to the shape of the head since precisely the bristles positioned in the centre of the array of bristles which would in actual fact have to yield to the greatest extent in order to achieve an adjustment to the shape of the head yield to the least extent since they are supported by the surrounding bristles and are therefore prevented from yielding.

Hair brushes which adjust better to the shape of the head have therefore hitherto been provided with an array of bristles which are anchored on a flexible, yielding pad of bristles and in this manner form an array of bristles which is better able to adapt to the shape of the head.

The bristles of such brushes are generally produced from metal pins or resilient metal wires which are retained at one end by a rubber membrane or plate which forms the pad of bristles. The bristles are pressed onto the skin of the head during brushing. The forces which arise in this case deform the pad of bristles or the rubber membrane. The base of the bristles is displaced as a result of this, as a result of which there is a change in the position and/or the spatial alignment of the bristles which are thus adapted to the shape of the head.

The separate manufacture of the bristles and the subsequent fitting of the rubber membrane with these bristles result in a certain amount of outlay which is undesirable.

It is accordingly the object of the invention to create a hair brush which has bristles, the position of which can change during combing and which are easier to produce than the previously known brushes.

SUMMARY OF THE INVENTION

This object is achieved according to the invention by a hair brush which has an array of bristles fastened on a flexible pad of bristles. The pad of bristles yields under the forces which occur during combing according to instructions such that, as a result, the base of the respective bristles and thus the bristle as a whole are displaced and/or so that the bristle as a whole pivots, i.e. its alignment in the space is displaced.

The bristles are composed of plastic, the pad of bristles is configured as a flexible membrane and the bristles and the membrane are composed from a single piece which is produced by injection moulding. The bristles can therefore not be separated from the membrane without destruction, there are also no joints between the bristles and the membrane in the region of the roots of the bristles even as seen under the microscope.

The bristles and the membrane, from which they exit, are preferably not only composed from one piece, rather they are also formed from one material, and are therefore composed of a single plastic material. The plastic membrane and the bristles are ideally injection-moulded in a single pass. This enables extremely efficient and low-cost production.

A preferred material for the production of the bristles and the membrane is HDPE. The bristles and the membrane are ideally not composed of a rubbery-elastic material or plastic.

In other cases, it may be advantageous to produce the bristles and the membrane in one piece, but from different plastic materials which are welded to one another during manufacture and as a result are connected in one piece. As a result of this, it is possible to adjust the flexibility of the bristles and the membrane almost "separately" from one another precisely as required. The details of this type of manufacture are explained in greater detail together with the exemplary embodiments.

The term "membrane" is best described functionally. A membrane within the meaning of the invention refers to a very thin plastic plate. This can be bent in the simplest case by the forces which occur in the case of use of the brush according to the instructions more than only insignificantly about at least one axis. The thin plastic plate is generally configured such that it can be bent by the forces which occur in the case of use of the brush according to the instructions more than only insignificantly about two axes which are perpendicular to one another. The membrane can as a result be easily deformed so that it forms a significantly spherical surface on one side—the side from which the bristles protrude preferably forms a spherical surface.

The membrane generally has two main surfaces, wherein the bristles protrude from at least one of these main surfaces. The main surfaces are characterized in that it applies to each of the main surfaces that their free surface area is larger at least by a factor of 7.5, preferably at least by a factor of 25 than the sum of the free surface area of all auxiliary surfaces (auxiliary surfaces here are those surfaces which form the narrow sides of the membrane).

The thickness of the membrane perpendicular to the surface of its main surfaces is preferably in the range between 0.25 mm and 1.25 mm and ideally in the range between 0.3 mm and 0.8 mm, in each case including the limit values.

If one considers that the other two edge lengths of the membrane are in the range between 15 mm×30 mm up to 50 mm×75 mm (limit values included in each case), it is then clear that the membrane is a very thin-walled structure, i.e. in the widest sense a cuboid which has two very large edge lengths and thus in comparison a very small height.

It is expedient to provide the membrane with at least one and preferably a plurality of slits. The slits ideally run substantially parallel to one another and preferably run at least substantially parallel to the longest side edge of the membrane. The bending and curvature characteristics of the membrane can be selectively influenced with such slits—in particular within the meaning that the membrane is curved in a pronounced but defined manner when it is clamped in the bristle carrier so that said bristle carrier exerts pressure on all sides on its auxiliary surfaces in the direction of the imaginary centre point of the membrane. As a result of the slits, it is not necessary to configure the membrane to be too thin. The membrane can instead have a specific thickness as a result of the slits so that it does not yield prematurely as a result of its thickness and the pretensioning preferably transmitted by pressure on its auxiliary surfaces when the brush is pulled through the hair, rather only when this is carried out with a certain subsequent pressure.

The edges of the membrane, which form the edge of a slit, expediently do not contact, even in the case of a membrane not under tension. The slits are therefore "recesses" in the membrane. In this manner, it is prevented that the edges of the slits are supported on one another or get caught during deflection of the membrane and thus impair its flexibility.

It is particularly expedient if the edges of the at least one slit are corrugated in the direction perpendicular to the main surface of the membrane. This results in the possibility of producing slits, the edges of which are very far from one another without excessively reducing the surface area of the relevant main surface on which bristles can be placed.

The membrane preferably has a circumferential edge which is self-enclosed all the way round. In this manner, the membrane can be clamped in the bristle carrier particularly easily and reliably and above all the membrane can be pretensioned particularly effectively by the bristle carrier (so that it assumes a spherical configuration) when it has an edge which is self-enclosed all the way round.

The membrane is ideally macroscopically corrugated in itself. The term "macroscopic" indicates that "waves" of the membrane in the form of surface roughness which is not visible with the naked eye or almost not visible do not represent corrugation within the meaning of the invention. On the contrary, according to the invention, only those waves which facilitate a compression or elongation of the membrane per se and as a result assist the deformation of the membrane to form, for example, a spherical structure by virtue of the fact that the regions of the membrane which are tendentially compressed in the case of such deformation can also actually be compressed and as a result do not hinder the desired deformation or to a lesser extent.

The corrugation is ideally formed uniformly. It is particularly good if the corrugation is formed such that the distance between a wave peak and an adjacent wave trough in the direction perpendicular to the wave front is between 7.5 mm and 0.5 mm and ideally between 1 mm and 3 mm.

The membrane and the bristles connected to it are preferably configured such that the membrane is substantially flat in a state where it is entirely free of tension (which it preferably only assumes prior to its installation in the bristle carrier)—apart from the corrugation which is possibly inherent to it. The bristles are sprayed onto the membrane in such a manner that they substantially converge in this state, i.e. the bristles are inclined towards one another in such a manner that their tips stand closer together than their roots by means of which they form a transition into the membrane. Such a formation has the advantage that the bristle field or its bristles only exhibit precisely the desired spatial alignment when the membrane has been installed into the bristle carrier under the structurally defined pretensioning and is curved as a result.

The hair brush expediently comprises a bristle carrier which preferably forms a transition into a brush handle and the brush carrier has a membrane receiving window which is configured such that the membrane can be fixed in the membrane receiving window in such a manner that the membrane has a convex and preferably multiply convex or spherical curvature on the side from which its bristles exit.

It is ideal if the membrane receiving window fully penetrates through the body of the bristle carrier. Such a configuration makes it possible, for example, in the case of a slit membrane, to blow from the rear side of the brush into the bristle field with a hairdryer, which is why a brush configured in this manner is highly suitable for drying hair. Such a configuration also enables, in the case of a correct configuration of the membrane, "folding together" of the bristle array, for example, in order to transport the brush in a pocket in a space-saving manner and without the possibility of unintended foreign bodies becoming caught in the bristle array. This folding together is carried out such that one presses with one's hand on the bristle array and this is carefully pushed in the direction of the window until the membrane collapses and "snaps over" such that its spherical side is no longer the side occupied by the bristles, rather the opposite side.

Further effects, advantages and possible configurations of the invention will become apparent from the following description of several exemplary embodiments on the basis of the figures.

In a similar manner to FIGS. 1 to 6, and 8 to 15, FIGS. 14 to 19, and 20 to 25, as well as 26 to 31 show respectively a third, fourth and fifth exemplary embodiment, in each case in the positions set out by FIGS. 1 to 6.

DETAILED DESCRIPTION OF THE PREFERRED EMBODIMENTS

The hair brush according to the invention which FIGS. 1 to 6 show is characterized by reference number 1, it comprises a brush handle 2 and a bristle carrier 3. Bristle carrier 3 is embodied here as a circumferential frame which has a membrane receiving window 4.

Figure 7:
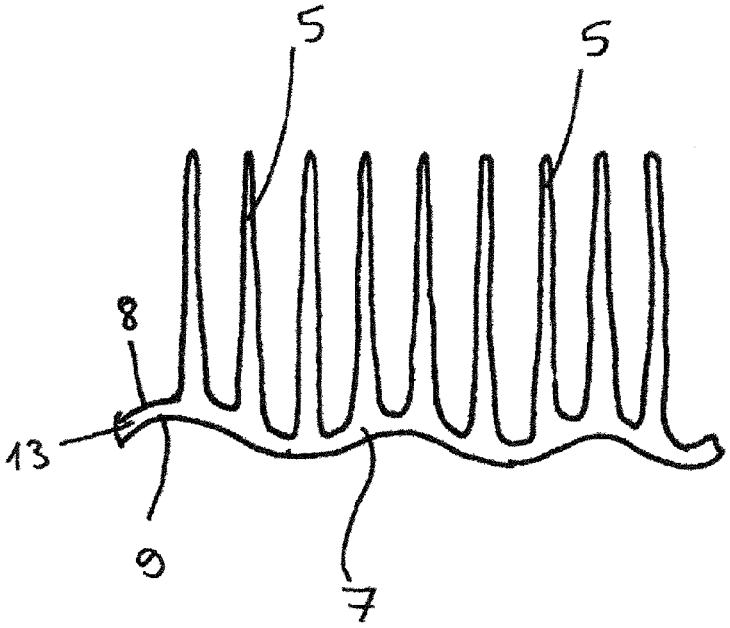
FIG. 7 schematically shows the unit of bristles and membrane as it is used for the first exemplary embodiment.
Figure 11:
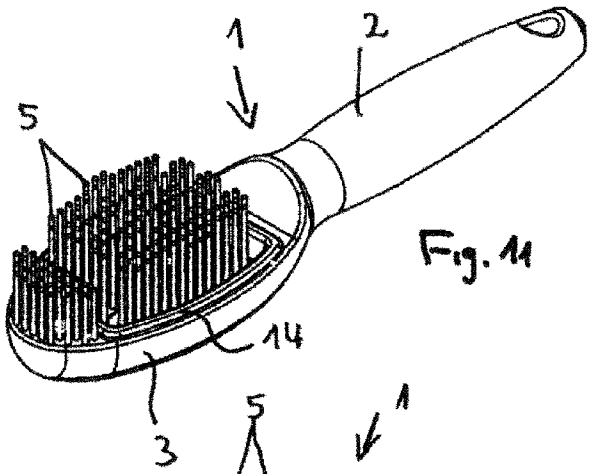
FIG. 11 shows a second exemplary embodiment of the hair brush according to the invention in a perspective view.
Figure 12:
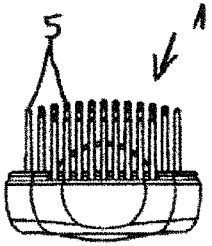
FIG. 12 shows a second exemplary embodiment of the hair brush according to the invention as seen from its tip facing away from the handle.
Figure 13:
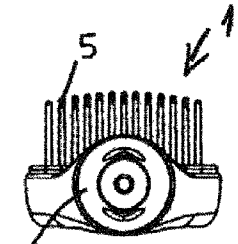
FIG. 13 shows a second exemplary embodiment of the hair brush according to the invention as seen from its side facing the handle.
Figure 8:
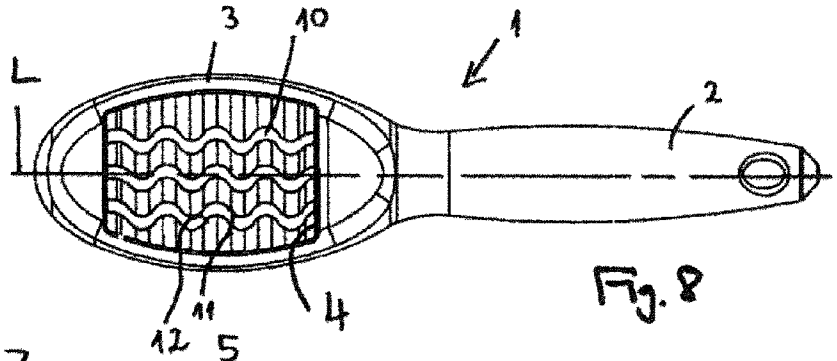
FIG. 8 shows a second exemplary embodiment of the hair brush according to the invention as seen from its side facing away from the bristle array.
Figure 9:
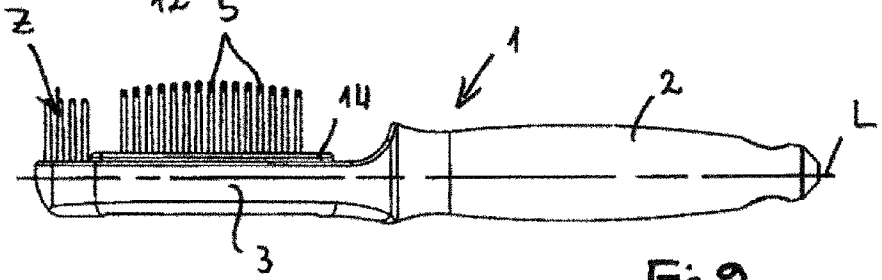
FIG. 9 shows a second exemplary embodiment of the hair brush according to the invention as seen from the side.
Figure 10:
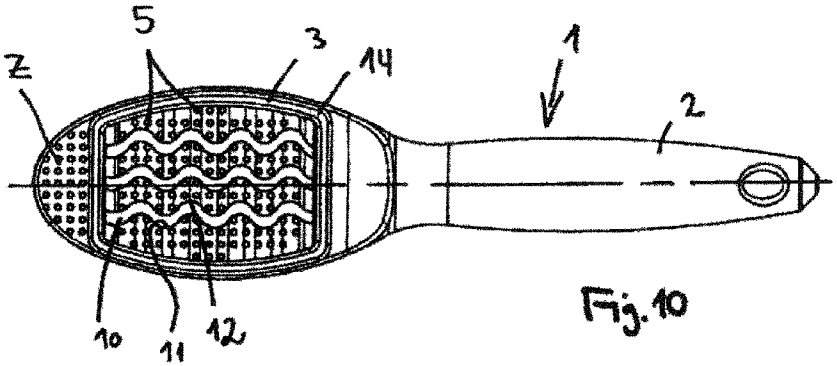
FIG. 10 shows a second exemplary embodiment of the hair brush according to the invention as seen from its side facing the bristle array.
Figure 17:
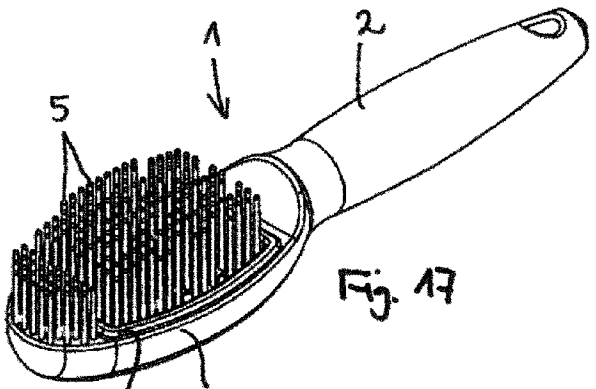
Figure 18:
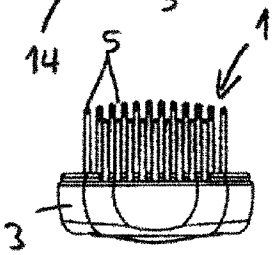
Figure 19:
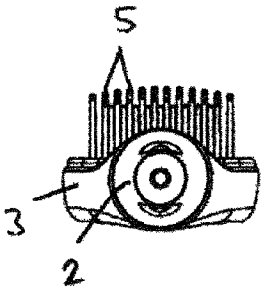
Figure 14:
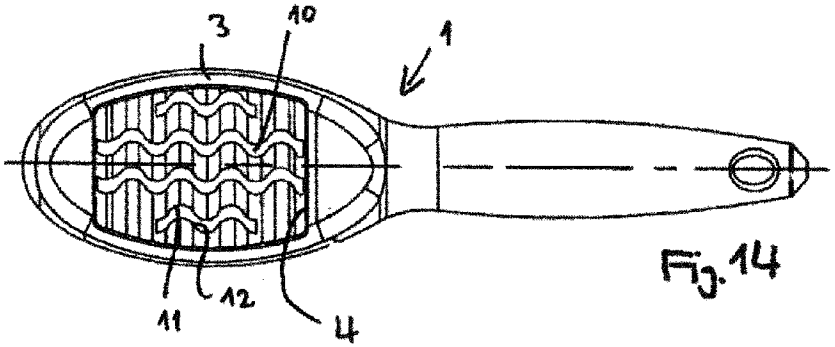
Figure 15:
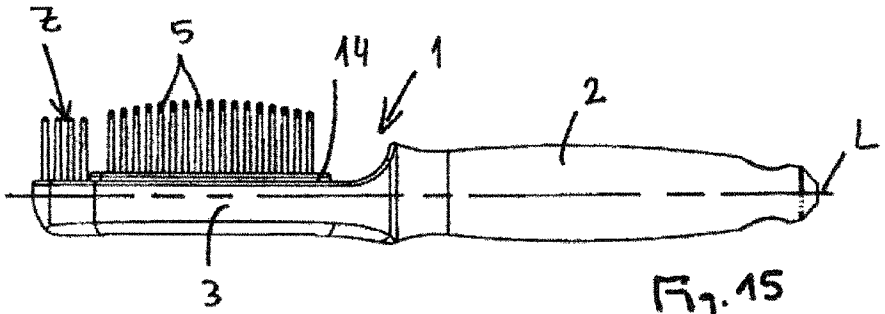
Figure 16:
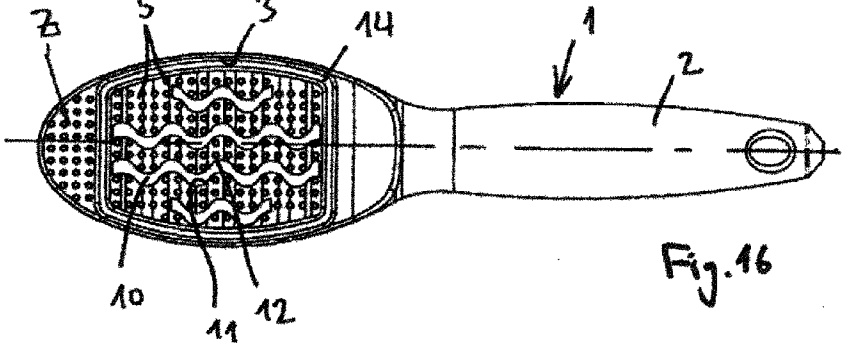
Figure 23:
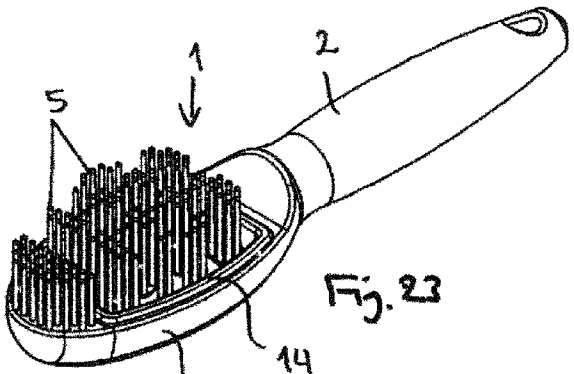
Figure 24:
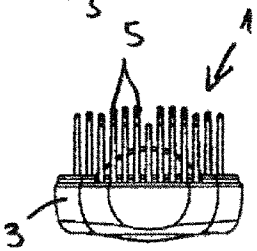
Figure 25:
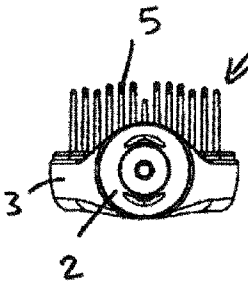
Figure 20:
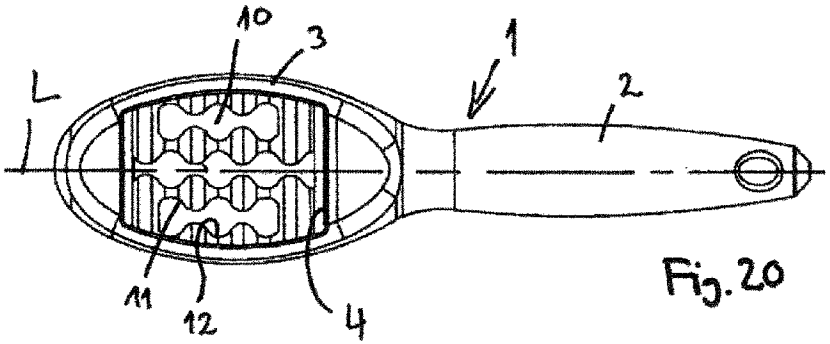
Figure 21:
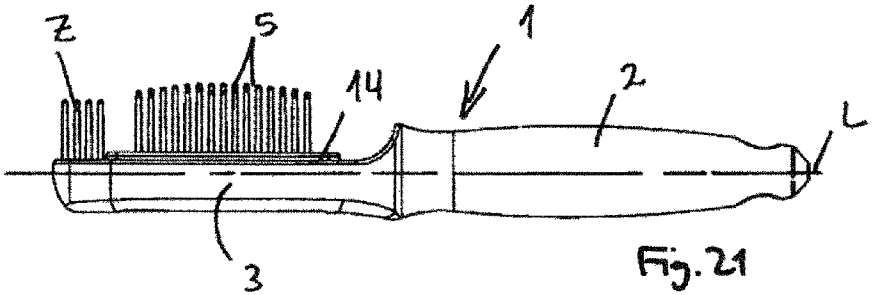
Figure 22:
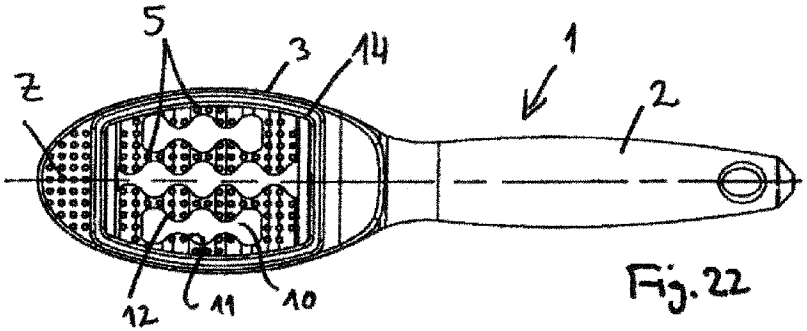
Figure 29:
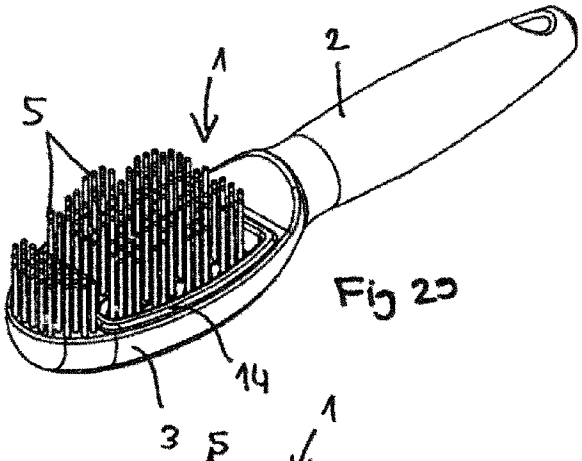
Figure 30:
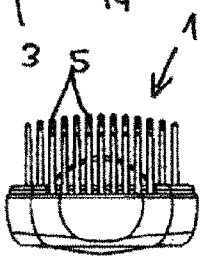
Figure 31:
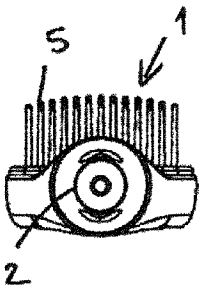
Figure 26:
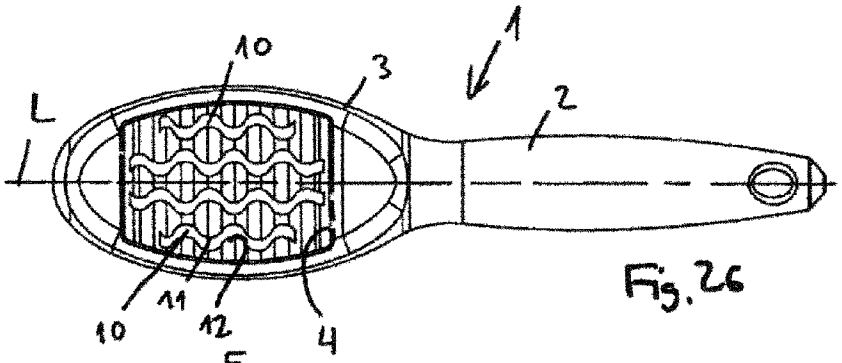
Figure 27:
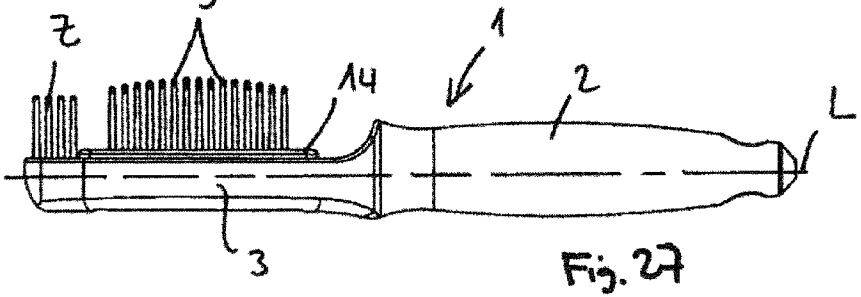
Figure 28:
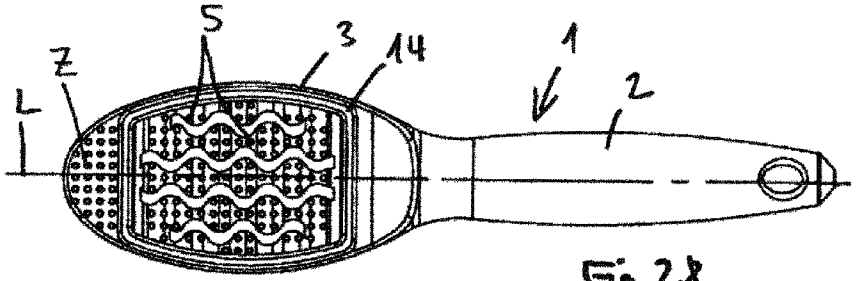

A unit comprising bristles 5 and membrane 7 connected thereto in one piece is inserted into said membrane receiving window 4, as FIG. 7 schematically shows. Bristles 5 are preferably slightly conical and as a result ultimately adjusted to their loading—where the loading is the highest, namely in the region of the bristle base, the bristle is its thickest. This configuration also promotes their deformability. The bristles are in one piece in the case of this exemplary embodiment and connected integrally to membrane 7. The corrugation of membrane 7 is clearly apparent on the basis of FIG. 7. This corrugation is also apparent on the basis of FIG. 1, and one sees there that the waves form a wave front which runs substantially at a right angle to longitudinal axis L of the hair brush.

Fastening of membrane 7 in membrane receiving window 4 is expediently carried out either by welding or in that the bristle array is held clamped by a frame 14 which is pressed from one side into the membrane receiving window and membrane 7 is pressed against a shoulder, not shown here, of the membrane receiving window and as a result holds it clamped between itself and this shoulder.

The circumference of the membrane along its auxiliary surfaces 13 is preferably slightly larger than the inner circumference of membrane receiving window 4. In this manner, the soffits of membrane receiving window 4 press on all sides on auxiliary surfaces 13 of the membrane. As a result, the membrane is compressed, it gives way and forms a curvature comparable to the curvature which was to be arrived at in the case of prior art pads of bristles in the form of rubber plates.

Alternatively, however, this can also be such that membrane receiving window 4 and the circumference of membrane 7 along its auxiliary surfaces 13 are adjusted to one another in such a manner that membrane 7 can be inserted into membrane receiving window 4 in a substantially tension-free manner. In this case, the membrane remains substantially flat even after its insertion.

As can be seen with relative ease, the membrane is provided with slits 10, edges 11 and 12 of which are spaced apart from one another so far that these two edges do not meet even in the state of membrane 7 free of tension. In this manner, the membrane forms several bending beams which are arrayed with bristles in such a manner that the bristles bases can give way in the event of loading so that the relevant bristles can preferably all move. The slits preferably do not run in a straight line, rather form a wave pattern here. As a result of this, the bending beams are stabilised in the transverse direction perpendicular to the longitudinal axis of the hair brush, i.e. they provide better resistance to torsion.

Figure 4:
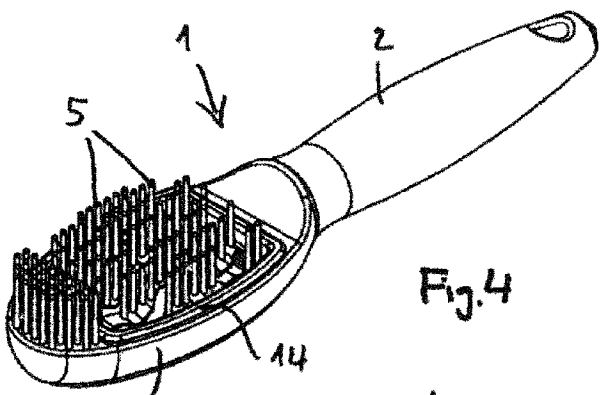
FIG. 4 shows a first exemplary embodiment of the hair brush according to the invention in a perspective view.
Figure 5:
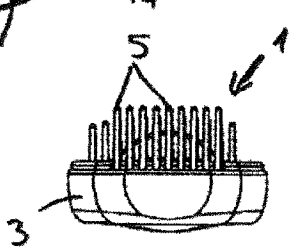
FIG. 5 shows a first exemplary embodiment of the hair brush according to the invention as seen from its tip facing away from the handle.
Figure 6:
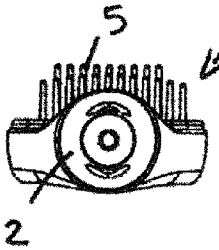
FIG. 6 shows a first exemplary embodiment of the hair brush according to the invention as seen from its side facing the handle.
Figure 1:
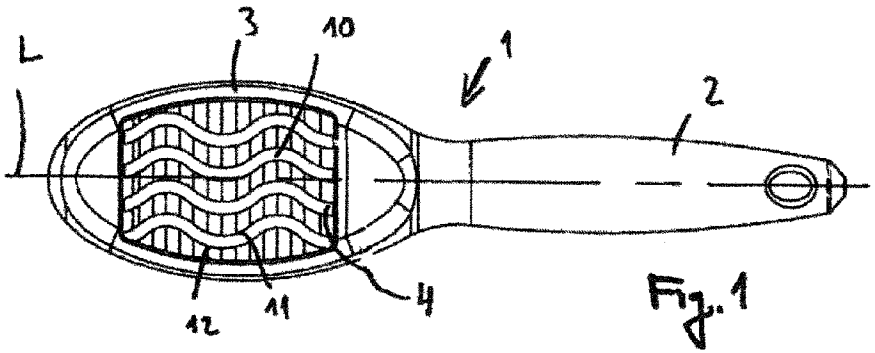
FIG. 1 shows a first exemplary embodiment of the hair brush according to the invention as seen from its side facing away from the bristle array.
Figure 2:
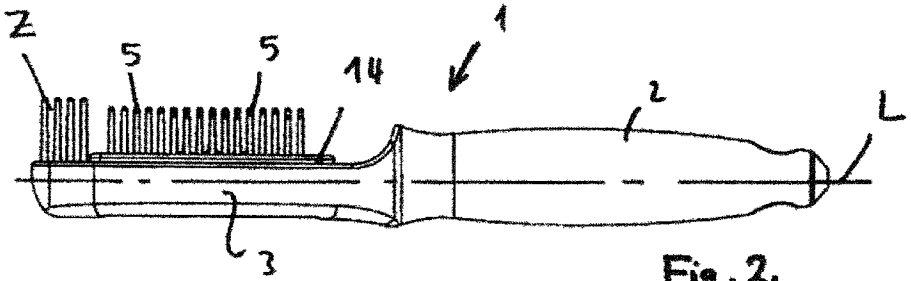
FIG. 2 shows a first exemplary embodiment of the hair brush according to the invention as seen from the side.
Figure 3:
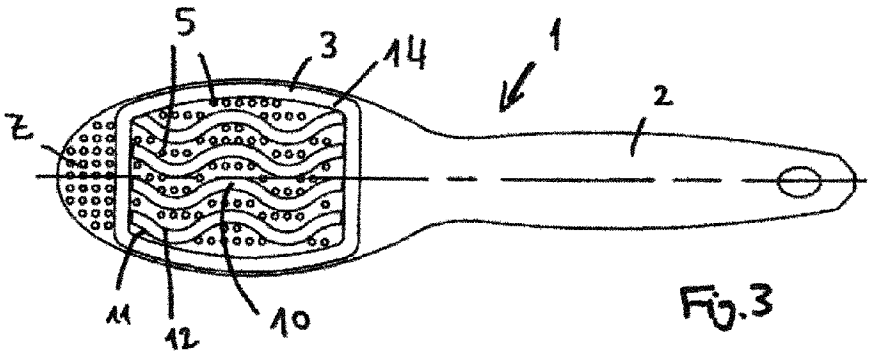
FIG. 3 shows a first exemplary embodiment of the hair brush according to the invention as seen from its side facing the bristle array.

Moreover, membrane 7 is preferably provided with a corrugation as FIG. 7 indicates and as is apparent on the basis of FIG. 1. The corrugation of the membrane means that its bending beams can be made more flexible in the direction of the longitudinal axis. The bending beams can then bend through better—a bending beam fixedly clamped at both ends is known to be hindered in its bending since traction forces occur in the direction of its longitudinal axis as a result of the clamping of its two ends during bending, which traction forces hinder further bending. The corrugation obviates this effect since it allows elongation or compression.

The corrugation is advantageous both when the membrane is installed flat and when the membrane is pretensioned by its installation in membrane receiving window 4 in such a manner that it is spherical. In the latter case, the corrugation facilitates the membrane or its bending beam assuming the desired spherical form. The corrugation is, however, also as stated advantageous when the membrane is clamped substantially flat, i.e. without pretensioning, into membrane receiving window 4. The corrugation enables improved bending through of the bending beams since it enables a certain elongation of the bending beams.

The membrane and the bristles are preferably arranged relative to one another and configured in such a manner that the bristles are aligned substantially parallel to one another after insertion of membrane 7 into the membrane receiving window and the deformation of membrane 7 which is associated with it under certain circumstances.

It is still noteworthy that the bristle carrier, as well as the membrane receiving window, is itself fitted, preferably in the region of the tip of the brush facing away from the brush handle, with an additional bristle field Z. These bristles are mounted on a rigid bristle carrier and therefore make it possible to counteract any higher-resistance deformation or forces which tend to deform them. This bristle field can, for example, be very effectively used in order, when combing long hair, to pull the brush with some force through that part of the hair on which tangles or adhesions are fixed.

FIGS. 8-13 shows a second exemplary embodiment. This second exemplary embodiment largely corresponds to the first exemplary embodiment. As a result of this, that which has been stated for the first exemplary embodiment also applies to this second embodiment. The sole difference from the first embodiment is that, in the case of the second embodiment, a narrower bristle array is provided and slits 10, which are machined into membrane 7, have more pronounced corrugation.

The same correspondingly applies to FIGS. 14-19 which in turn only exhibit a different corrugation of the slits in the membrane.

The two exemplary embodiments which FIGS. 20-25 and 26-31 show are of particular interest. These two exemplary embodiments also substantially correspond to the first exemplary embodiment described. It is, however, the case here that the slits in the membrane are even more pronounced. The peculiarity in the case of these two exemplary embodiments is that the slits here delimit between them bending beams of the membrane which have pronounced constrictions and therefore are very flexible, even in the direction of longitudinal axis L of the hair brush.

The invention claimed is:

1. A hair brush, comprising:

a brush handle;

a bristle carrier attached to the brush handle; and an array of bristles fastened on a flexible pad which yields during combing such that a position and/or location of the bristles change(s) as a result, wherein the bristles are composed of plastic, the pad and the bristles are composed from a single piece, and the pad is a flexible membrane that is macroscopically corrugated in itself, wherein the bristle carrier has a circumferential frame with a membrane receiving window.

2. The hair brush according to claim 1, wherein the membrane generally has two main surfaces, the bristles protrude from at least one of these main surfaces and a sum of a surface area of the main surfaces is substantially larger than a sum of a surface area of auxiliary surfaces which connect the two main surfaces of the membrane.

3. The hair brush according to claim 2, wherein a thickness of the membrane perpendicular to the surface of its main surfaces is between 0.25 mm and 1.25 mm.

4. The hair brush according to claim 1, wherein the membrane has at least one slit.

5. The hair brush according to claim 4, wherein edges of the membrane, which form edges of a slit, do not contact, even in the case of a membrane not under tension.

6. The hair brush according to claim 4, wherein edges of the at least one slit are corrugated in a direction perpendicular to a main surface of the membrane.

7. The hair brush according to claim 1, wherein the membrane has a continuous circumferential edge.

8. The hair brush according to claim 1, wherein the membrane is macroscopically corrugated in itself and the corrugation forms a regular wave pattern.

9. The hair brush according to claim 1, wherein the bristles protrude from the membrane in such a manner that their tips converge when the membrane is not under tension.

10. The hair brush according to claim 1, wherein the bristle carrier forms a transition into the brush handle and the membrane receiving window is configured such that the membrane can be fixed in the membrane receiving window in such a manner that the membrane has a convex or spherical curvature on a side from which its bristles exit.

11. The hair brush according to claim 10, wherein the bristle carrier has a body, and the membrane receiving window fully penetrates through the body of the bristle carrier.

12. A pad of bristles, comprising a plurality of the bristles composed of plastic, wherein the pad of bristles is a flexible membrane that is macroscopically corrugated in itself and is not glued or welded to a bristle carrier, and the pad of bristles is designed for insertion into a bristle carrier, wherein the pad of bristles and the bristles are composed from a single piece, and the bristle carrier has a circumferential frame with a membrane receiving window.

* * * * *